United States Patent [19]

Soes

[11] Patent Number: 4,464,550

[45] Date of Patent: Aug. 7, 1984

[54] ELECTRICAL SWITCH HAVING SELECTIVE CODING CAPABILITY

[75] Inventor: Lucas Soes, Rosmalen, Netherlands

[73] Assignee: AMP Incorporated, Harrisburg, Pa.

[21] Appl. No.: 490,815

[22] Filed: May 2, 1983

[30] Foreign Application Priority Data

May 13, 1982 [GB] United Kingdom ..... 8213890

[51] Int. Cl.[3] ..... H01H 27/00

[52] U.S. Cl. ..... 200/46; 200/44; 200/283; 200/153 LA; 200/51 R

[58] Field of Search ..... 200/44, 45, 43, 42 R, 200/42 A, 46, 153 LA, 153 L, 329, 283, 153 M, 51 R; 70/409, 410

[56] References Cited

U.S. PATENT DOCUMENTS

| | | | |
|---|---|---|---|
| 1,526,516 | 2/1925 | Vives | 70/410 |
| 1,752,770 | 4/1930 | Armstrong | 200/44 |
| 2,545,395 | 3/1951 | Tobin | 200/45 |
| 3,564,169 | 2/1971 | Sitz et al. | 200/46 |
| 3,957,334 | 5/1976 | Pass et al. | 200/46 X |
| 4,277,663 | 7/1981 | Soes | 200/283 |
| 4,319,102 | 3/1982 | Van Cleave et al. | 200/46 |
| 4,371,759 | 2/1983 | Clark, Jr. | 200/5 R |

FOREIGN PATENT DOCUMENTS

| | | | |
|---|---|---|---|
| 996351 | 6/1965 | United Kingdom | 200/46 |

*Primary Examiner*—Stephen Marcus
*Assistant Examiner*—Ernest G. Cusick
*Attorney, Agent, or Firm*—F. W. Raring

[57] ABSTRACT

An electrical switch for use as a coding device comprises a plurality of pairs of associated contacts (2, 3) carried in a circular array by a base (1) and enclosed by a cover (5), and a coding key (11) receivable in holes (20, 21) in the base (1) and cover (5) and having removable actuator surfaces (32) the presence or absence of each of which determines the closed or open state of an associated pair of contacts (2, 3).

7 Claims, 4 Drawing Figures

FIG.1.
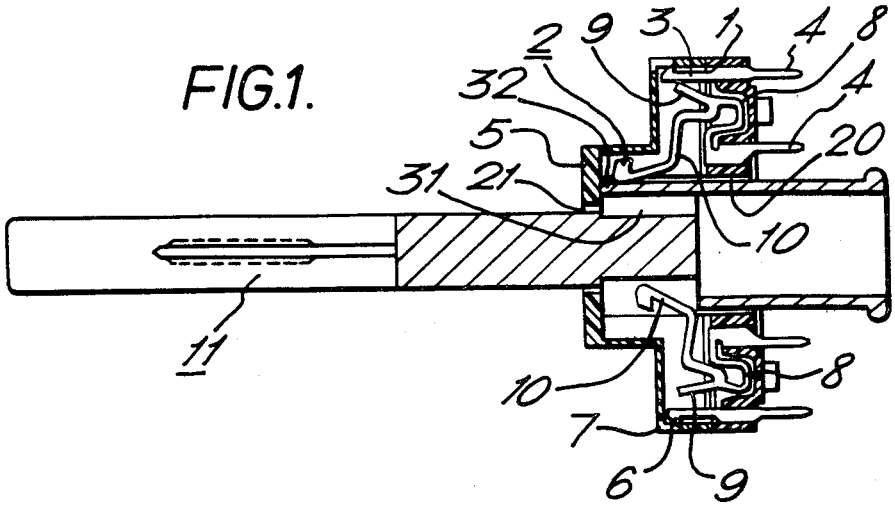
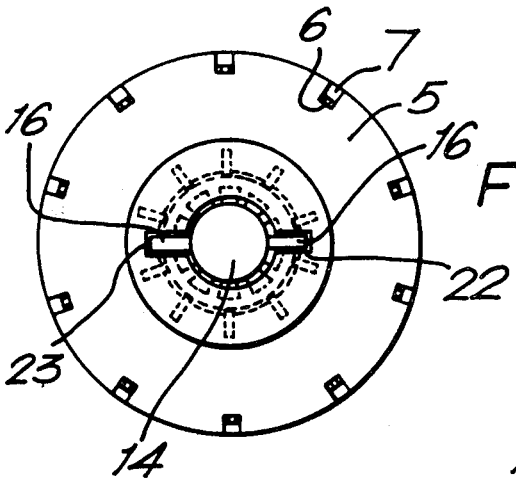
FIG.2.
FIG.3.
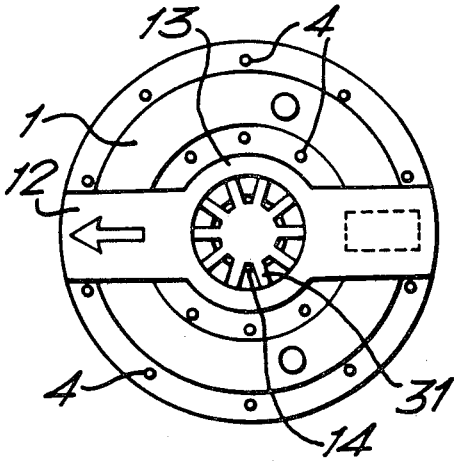

ELECTRICAL SWITCH HAVING SELECTIVE CODING CAPABILITY

This invention relates to an electrical switch, and particularly to an electrical switch for use as a coding device.

In many industries there is a need for a coding device which can be selectively set to make any desired one or more of a plurality of possible circuits through the device.

According to this invention an electrical switch comprises a plurality of resilient contacts mounted on an insulating base in an array about a hole in the base; a plurality of fixed contacts mounted on the base and respectively associated with the resilient contacts; and a coding key receivable in the hole in the base in a particular orientation and formed with a plurality of removable actuator surfaces respectively associated with the resilient contacts, the presence or absence of any actuator surface determining the closed or open state of the associated resilient and fixed contact pair when the key is inserted into the hole in the base.

An electrical switch according to this invention will now be described by way of example with reference to the drawings, in which:

FIG. 1 is a longitudinal sectional view through the switch;

FIG. 2 is a view of the left-hand end of the switch as shown in FIG. 1;

FIG. 3 is a view of the right-hand end of the switch as shown in FIG. 1; and

Figure 4:
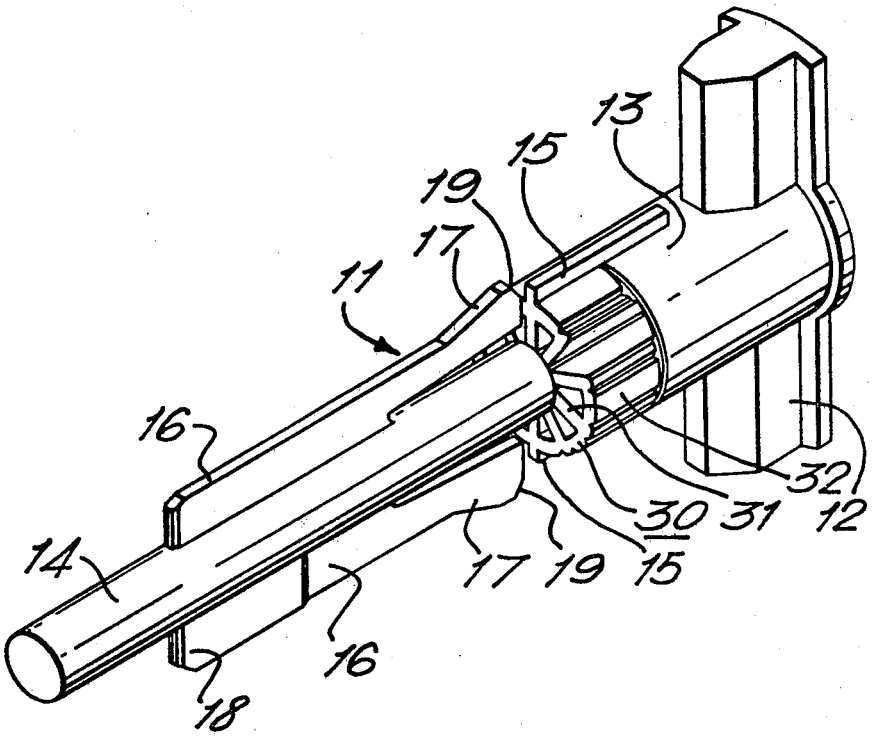
FIG. 4 is a perspective view of the coding key of the switch.

The switch comprises a circular base 1 moulded from a synthetic plastics material and carrying a plurality of resilient metal contacts 2 arranged in a circle about the centre of the base 1 and a corresponding plurality of fixed metal contacts 3 respectively associated with the resilient contacts 2 and arranged in a circle about the resilient contacts 2. Each of the resilient and fixed contacts 2 and 3 has a pin portion 4 projecting from a common surface of the base 2 for receipt in a hole in a printed circuit board (not shown).

The contacts 2 and 3 are enclosed on the base 1 by a cover 5 moulded from synthetic plastics material and secured to the base 1 by the fixed contacts 3 which have hooked ends 6 remote from the pin portions 4, which engage in respective holes 7 around the periphery of the cover 5.

Each resilient contact 2 extends from the pin portion 4 as a single, sinuous inner limb 8 which divides into two outer limbs 9 and 10 one of which (9) co-operates with the associated fixed contact 3 to provide a switch function, and the other of which (10) projects inwardly towards the axis of the base 1 and cover 5. The form and operation of such resilient contacts are fully discussed in EP-A- 0016550 and will not therefore be discussed in detail herein.

The switch is completed by a coding key 11 receivable through aligned holes 20 and 21 in the base 1 and cover 5 respectively. The key 11 is substantially T-shaped having a head 12 carried by a first circular cross-section portion 13 of relatively large diameter, which carries at its other end a second circular cross-section portion 14 of relatively small diameter. The portion 13 is formed with a pair of diametrically opposed radially extending longitudinal ribs 15, while the portion 14 is formed with a similar pair of ribs 16 aligned with the ribs 15. End portions 17 of the ribs 16 adjacent the portion 13 are free of the portion 14 and are flared outwardly. One of the ribs 16 (lower one in FIG. 4) has a portion 18 at its end remote from the flared, free end portion 17 of greater thickness than the remainder of that rib 16 and greater than the thickness of the other rib 16.

The holes 20 and 21 in the base 1 and cover 5, which receive the key 11 are each formed with a pair of peripheral radially extending diametrically opposed slots 22 and 23 (FIG. 2) of mutually different width which just receive the unthickened rib 16 and the thicker portion 18 of the other rib 16, respectively. Thus, the key 11 can be inserted through the holes 20 and 21 in only one angular orientation.

When the key 11 is inserted through the holes 20 and 21 from the side of the base 1, the ribs 15 on the portion 13 of the key 11 become received in the slots 22 and 23 in the base 1 and cover 5 thereby to prevent rotation of the key 11 relative to the base 1. The free end portions 17 of the ribs 16 pass through the slots 22 and 23 in the cover 5, being deflected inwardly as they pass through, and then return to their original condition to engage the outside of the cover 5 thereby to resist withdrawal of the key 11. As shown in FIG. 4 the free end portions 17 have cam surfaces 19 which engage the cover 5 and cam the free end portions 17 inwardly to permit withdrawal of the key 11 from the holes 20 and 21 when required by the application of a sufficiently high force.

The portions 13 and 14 of the key 11 are connected by way of a portion 30 formed by a plurality of radially extending flanges 31 having their outer ends joined by removable circumferential actuator surfaces 32 respectively associated with the resilient contacts 2.

The arrangement is such that when the key 11 is inserted through the holes 20 and 21 in the base 1 and cover 5 the free ends of the arms 10 of the resilient contacts 2 engage the surfaces 32 on the key 11 where they are present this effecting closing of a resilient contact 22 so engaged onto the associated fixed contact 3, as shown for the two pairs of contacts shown in FIG. 1. However, if a surface 32 has been removed, then on insertion of the key 11 the associated resilient contact 2 is not engaged and does not contact its associated fixed contact 3. FIG. 4 shows the key 11 with one surface 32 removed. In FIG. 1, the upper resilient contact is in engagement with a surface 32 and is therefore in contact with the fixed contact 3. The lower resilient contact is not in engagement with its associated fixed contact for the reason that the surface 32 has been removed.

Thus, by removing surfaces 32 as necessary the switch can be used as a coding device by providing connections through only required ones of the contact pairs 2 and 3. Thereafter, by the removal of further surfaces 32, or by the use of a different coding key 11 having different actuator surfaces removed, the coding can be changed.

For use, the switch is mounted on a printed circuit board with the contact pins received in holes in the board and electrically connected to conductors thereon, there being a hole in the board aligned with the holes 20 and 21 in the base 1 and cover 5, such that the coding key 11 can be inserted through the hole in the board until the head 12 of the key 11 engages the surface of the board remote from that on which the base 1 and cover 5 with the contact 2 and 2 thereon, are mounted.

What is claimed is:

1. An electrical switch comprising a plurality of resilient contacts mounted on an insulating base in an array about a hole in the base, a plurality of fixed contacts mounted on the base and respectively associated with the resilient contacts, a cover enclosing the resilient and fixed contacts on the base, the cover having a cover hole which is in alignment with the hole in the base, and a coding key receivable in the hole in the base and in the cover hole, the key having radially extending ribs, the cover having slots extending radially from the cover hole, the base having slots extending radially from the hole in the base, the slots in the cover and in the base being dimensioned to receive the ribs so that the key can be received only in a particular orientation, a plurality of removable actuator surfaces on the key respectively associated with the resilient contacts, the actuator surfaces being effective to engage the resilient contacts with the fixed contacts when the key is inserted into the hole in the base whereby upon removal of one of the actuator surfaces, the resilient contact associated with the removed actuator surface will not engage the associated fixed contact.

2. A switch as claimed in claim 1, in which the cover is secured to the base by means of the fixed contacts which have hooked portions engage in holes in the cover.

3. A switch as claimed in claim 1, in which the resilient and fixed contacts have pin portions all projecting from a common face of the base for receipt in holes in a printed circuit board.

4. A switch as claimed in claim 1, in which the base has an axis which is co-axial with respect to the axis of the key and each resilient contact extends from the base as a single inner limb which divides into two outer limbs, one of which co-operates with the associated fixed contact and the other of which projects inwardly towards the axis of the base for co-operation with the associated actuator surface of the coding key.

5. A switch as claimed in claim 1, in which the slots in the base are of mutually different width, one of the ribs on the key having a thickened portion receivable in the larger slot only whereby the key can be inserted into the hole in the base in only one angular orientation.

6. A switch as claimed in claim 1, in which the ribs have outwardly flared free end portions which are deflected inwardly on passage through the hole in the cover and thereafter return to their original condition to secure the key in the holes in the base and cover.

7. A switch as claimed in claim 1, in which the coding key has a portion formed by a plurality of radially extending flanges which have outer ends, the outer ends of the flanges being joined by the removable actuator surfaces.

* * * * *